US006761290B2

(12) United States Patent
Righolt et al.

(10) Patent No.: US 6,761,290 B2
(45) Date of Patent: Jul. 13, 2004

(54) DEVICE FOR APPLYING FLUID MATERIAL ON A SUBSTRATE, AND APPLICATION VALVE

(75) Inventors: Hendrik-Jan Righolt, Oosterhout (NL); Victor de Leeuw, Hilvarenbeek (NL)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/459,836

(22) Filed: Jun. 12, 2003

(65) Prior Publication Data

US 2003/0205589 A1 Nov. 6, 2003

Related U.S. Application Data

(63) Continuation-in-part of application No. 09/855,964, filed on May 15, 2001.

(30) Foreign Application Priority Data

May 16, 2000 (DE) ..... 100 23 672

(51) Int. Cl.[7] ..... B67D 5/06
(52) U.S. Cl. ..... 222/504; 251/129.15; 239/585.1
(58) Field of Search ..... 222/504; 251/129.15–129.21; 239/585.1, 583, 584

(56) References Cited

U.S. PATENT DOCUMENTS

| | | | | | |
|---|---|---|---|---|---|
| 3,329,347 | A | * | 7/1967 | Montgomery | 239/583 |
| 3,633,139 | A | * | 1/1972 | Thompson | 335/255 |
| 3,811,601 | A | | 5/1974 | Reighard et al. | 222/146 HE |
| 3,827,604 | A | | 8/1974 | Hamilton et al. | 222/146 HE |
| 4,543,983 | A | | 10/1985 | Pauliukonis | 137/356 |
| 4,723,755 | A | | 2/1988 | Ishigaki | 251/129.19 |
| 4,812,884 | A | * | 3/1989 | Mohler | 335/258 |
| 5,375,738 | A | | 12/1994 | Walsh et al. | 222/1 |
| 5,407,101 | A | | 4/1995 | Hubbard | 222/146.5 |
| 5,535,919 | A | | 7/1996 | Ganzer et al. | 222/1 |
| 5,875,922 | A | | 3/1999 | Chastine et al. | 222/1 |
| 6,168,135 | B1 | * | 1/2001 | Fochtman | 251/129.15 |
| 6,305,583 | B1 | | 10/2001 | Ward et al. | 222/504 |
| 6,318,599 | B2 | | 11/2001 | Estelle et al. | 222/146.5 |
| 6,419,126 | B2 | | 7/2002 | Righolt | 222/330 |
| 2001/0052585 | A1 | | 12/2001 | Righolt et al. | 251/129.18 |

FOREIGN PATENT DOCUMENTS

| | | |
|---|---|---|
| DE | 3841474 | 6/1990 |

* cited by examiner

*Primary Examiner*—Gregory L. Huson
*Assistant Examiner*—Melvin A Cartagena
(74) *Attorney, Agent, or Firm*—Wood, Herron & Evans, L.L.P.

(57) ABSTRACT

The present invention pertains to a device for applying fluid material on a substrate. The device includes a valve body, a pole piece, and an electromagnetic drive unit that generates a magnetic field that moves the valve body relative to a pole piece between a closed position that interrupts the flow of material and an open position that releases the flow of material. The effect of the magnetic field provided by the drive unit is strengthened by the presence of a flux element. The flux element incorporates a portion, such as a slit, that eliminates circumferential electrical current paths, which allows the flux element to demagnetize more quickly when the drive unit is de-energized to remove the electromagnetic field. The rapid demagnetization decreases the cycle time for moving the valve body from the open position to the closed position.

19 Claims, 3 Drawing Sheets

DEVICE FOR APPLYING FLUID MATERIAL ON A SUBSTRATE, AND APPLICATION VALVE

CROSS-REFERENCE TO RELATED APPLICATIONS

This application is a continuation-in-part of application Ser. No. 09/855,964, filed May 15, 2001, the disclosure of which is hereby fully incorporated by reference herein.

FIELD OF THE INVENTION

The present invention pertains to a device for applying fluid material on a substrate and, in particular, to an application valve for such a device.

BACKGROUND OF THE INVENTION

In many industrial applications, fluid applying devices are used for intermittent delivery and application of liquids onto various objects (substrates), for example, in order to apply adhesives, coloring materials or the like onto automobile parts, packages, furniture or paper, on whole areas, in beads or in dots. The so-called application head with the valve assembly and nozzle assembly is part of a complex application system which includes a container for the fluid material, a transport pump, and a control unit for controlling and/or regulating the individual components. The substrate can be moved relative to the application head with the help of a transport system, or the application head may be attached to a robot arm, or the like, and can move relative to the substrate.

Intermittent application means that the flow or stream of the fluid material in the supply canal, and thus the emission of the material from the outlet opening of the nozzle assembly, is alternately released or interrupted by intermittent activation of the valve assembly. In this way, an interrupted pattern of material is created on the substrate; that is, for example, dots separated by intervals or interrupted longitudinal beads, or spaced rectangular sections of material when the material is applied on areas.

Particularly in applications where objects are to be moved past the application head at high speed and to have fluid material applied, intermittent interruption of the flow of material is necessary. At high relative speeds between the substrate and the application head and/or to create application patterns with small intervals between individual coated areas or short lengths B in the direction of relative motion B of coated area, the valve assembly must be activated at high switching frequency, or in other words, the valve body, which interrupts the flow of material in the supply canal, must be moved back and forth at high speed and high frequency.

Conventional application heads rely on a coil spring to pre-tension the valve body in the closed position. The fluid material, for example, adhesive, is supplied in an upper area of the main body and then flows through a canal which runs essentially axially in the main body, toward the outlet opening of the outlet canal, and at the same time flowing around the coil spring which is located in the outlet canal. A disadvantage of the known apparatus is that the flow path for the material through the main body is relatively long, which leads to relatively large pressure losses.

An additional known problem is that the adhesive fluid material in the portion of the flow path through and about the coil spring and armature introduces drag that increases as the pressure or viscosity of the adhesive fluid material increases.

The drag dramatically slows the movement of the armature for interrupting the flow of adhesive fluid material in the supply canal. As the adhesive fluid material flows through and about the entire length of the coil spring and armature, adhesive fluid materials of relatively high viscosity, in particular, are difficult to apply in accurate amounts due to the high drag experienced by the coil spring and the armature.

SUMMARY OF THE INVENTION

The present invention provides an apparatus in which a valve assembly can be switched rapidly and with high frequency so that the flow of material can be interrupted or released with high frequency. The apparatus promotes reliable, intermittent application of materials with high viscosities, especially liquid adhesives.

According to the invention, the apparatus includes a supply canal for supplying material from a source of material, a main body with an outlet canal which communicates with the supply canal and ends in an outlet opening for delivering the material, and with a valve assembly located in the main body for optional interruption of the flow of material in the outlet canal. The valve assembly has a valve seat and a valve body which can move relative to the valve seat, as well as a tensioning device which biases or pre-tensions the valve body in either a closed or open position. A drive unit moves the valve body between a closed position which interrupts the flow of material and an open position which releases the flow of material. The supply canal is located in a lower part of the main body and is connected to the outlet canal. The tensioning device for pre-tensioning the valve body is located in the lower part of the main body.

The apparatus of the invention reduces the effect of pressure variations in the fluid material, especially in the supply canal, on the application of the material and on the activation of the application valve. The total flow path, and thus the pressure loss within the applicator, is significantly smaller than in known devices. Furthermore, impairment of the tensioning device by the fluid material, especially sticking of the tensioning device, which is preferably in the form of a coil spring, can be prevented. Moreover, with the apparatus in accordance with the invention, highly viscous fluids can be applied reliably and high switching frequency of the valve assembly can be realized.

In one embodiment, in which the tensioning device is a coil spring, the valve assembly includes a needle valve with an elongated, needle-like valve body and an essentially ring-shaped projection on the valve body against which the coil spring rests. In the ring-shaped projection are flow canals through which the fluid material can flow, producing a simple design with low resistance to flow.

In accordance with an alternative embodiment, the outlet canal extends in the axial direction with reference to a longitudinal axis of the main body and the supply canal extends essentially in the radial direction in reference to the longitudinal axis of the main body. The supply canal intersects in the outlet canal in the area of the coil spring. This allows a compact construction to be achieved overall and allows sufficient space for connecting hoses or the like for supplying the fluid material.

In an alternative embodiment of the invention the outlet canal is disposed at least partially inside of a sleeve inserted into the main body. A sleeve of this sort is easily manufactured and can be designed in such a way that its fluid mechanics are optimal. Furthermore, the main body can consist of a different material. This optimizes the apparatus and lowers the overall production costs.

In another embodiment of the invention, the drive unit for moving the valve body has an electromagnetic coil arrangement configured to produce a magnetic field which operates on the valve body to move it to the closed or open position. A coil arrangement of this sort can be activated rapidly at high frequencies, so that a high switching frequency can be achieved for the valve assembly. The coil arrangement is easily controlled and eliminates the need for a source of pressurized air, such as is necessary for pneumatically operated valves. The application of force needed to move the valve body can be amplified by locating at least one magnetically active element, preferably in the form of a pole element or flux ring, adjacent to or close to the coil.

According to one aspect of this embodiment, an adjusting element is movable relative to the main body and can be secured in various positions, forming a stop for the movable valve body, so that the stroke of the movable valve body is adjustable. Preferably, the adjusting element has male threading and can be screwed into the main body or into a threaded sleeve which is set into the main body.

The adjusting element may be in the form of a pole piece that is permeable by the magnetic field induced by the coil assembly so that a relatively strong force is generated which acts in the axial direction on the valve body to move the valve body back and forth. In one operating state, the valve body preferably rests directly against the magnetically active adjusting element. The adjusting element may be pre-tensioned relative to the main body by a coil spring.

In accordance with an additional aspect of the invention, an advantage of manufacturing technique results from having the main body made of synthetic material. The other components of the applicator can be embedded, for example, in a cast main body. If the applicator is subject to high mechanical loads, the main body can be enclosed in a housing made of a hardened material, such as a sheet metal.

A separate connecting adapter, with a section of the supply canal, can be attached to the main body and receive a hose connector. This facilitates easy connections and attachments.

In another embodiment of the invention, an electrically-operated dispensing module includes a main body having an outlet canal capable of receiving viscous liquid and an outlet opening for discharging the fluid material flowing through the outlet canal onto the substrate, a pole piece positioned within the main body, and a valve assembly positioned within the outlet canal. The valve assembly has a valve seat and a valve body movable relative to the valve seat between a closed position interrupting the flow of fluid material in the outlet canal by engaging the valve body with the valve seat and an open position releasing the flow of fluid material in the outlet canal to the outlet opening by disengaging the valve body from the valve seat.

The dispensing module further includes an electromagnetic drive unit capable of generating a magnetic field for moving the valve body relative to the pole piece between the closed and open positions and a flux element positioned proximate to the electromagnetic drive. The flux element includes a portion capable of interrupting circumferential electrical current paths therein. As a result, any magnetic field induced by eddy currents in the flux element readily dissipates after the electromagnetic drive is denergized, which permits the dispensing module to be rapidly moved from the open position to the closed position.

BRIEF DESCRIPTION OF THE DRAWINGS

Various additional features, objects and advantages will be readily recognized upon further review of the exemplary embodiments. The invention is described below on the basis of the exemplary embodiment with reference to the attached drawings.

DETAILED DESCRIPTION OF THE PREFERRED EMBODIMENT

The device 1 illustrated on the basis of the sample implementation in accordance with FIGS. 1–4 is used to deliver and apply adhesive or other fluid materials on any desired substrate. The applicator head 1 is part of an application system which includes a source of material in the form of a container, a transport pump, lines or hoses through which the material can be transported to the applicator head 1, and control devices (not shown) for controlling and regulating individual components of the application system.

For purposes of this description, words of direction such as "upward," "vertical," "horizontal," "right," "left," "upper," "lower," "above," "below" "beneath" and the like are applied in conjunction with the drawings for purposes of clarity in the present description only. As is well known, liquid dispensing modules may be oriented in substantially any orientation, so these directional words should not be used to imply any particular absolute directions for an apparatus consistent with the invention.

Figure 1:
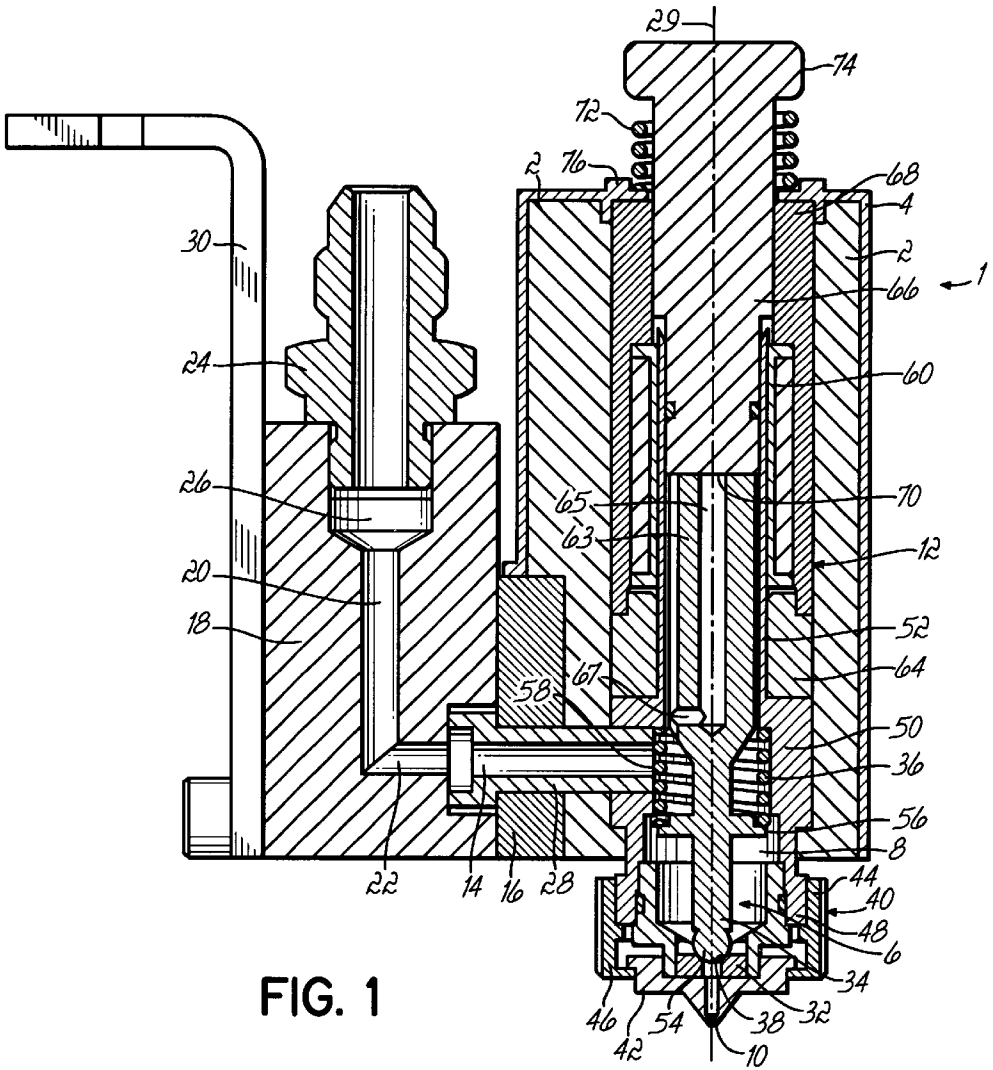
FIG. 1 is a cross-sectional view of an apparatus in accordance with the invention.
Figure 2:
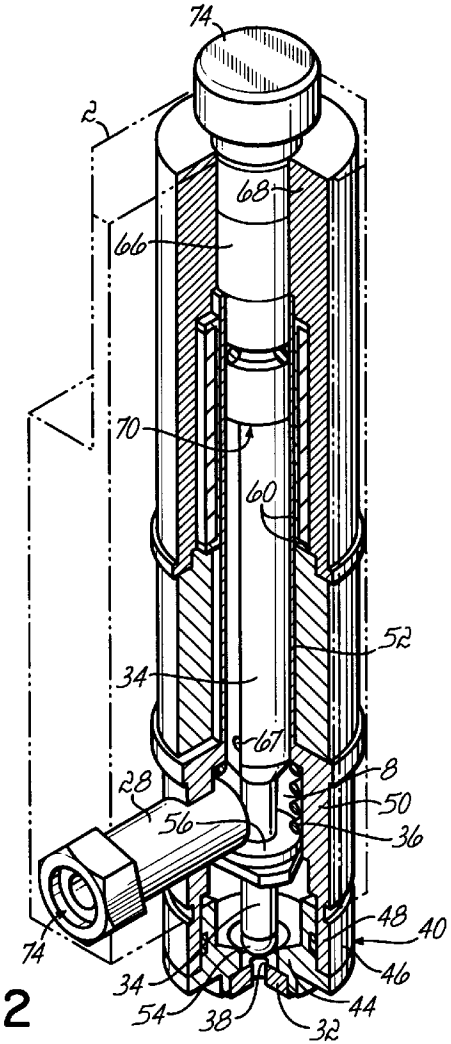
FIG. 2 is a partially cut away perspective view of an apparatus in accordance with the invention.
Figure 4:
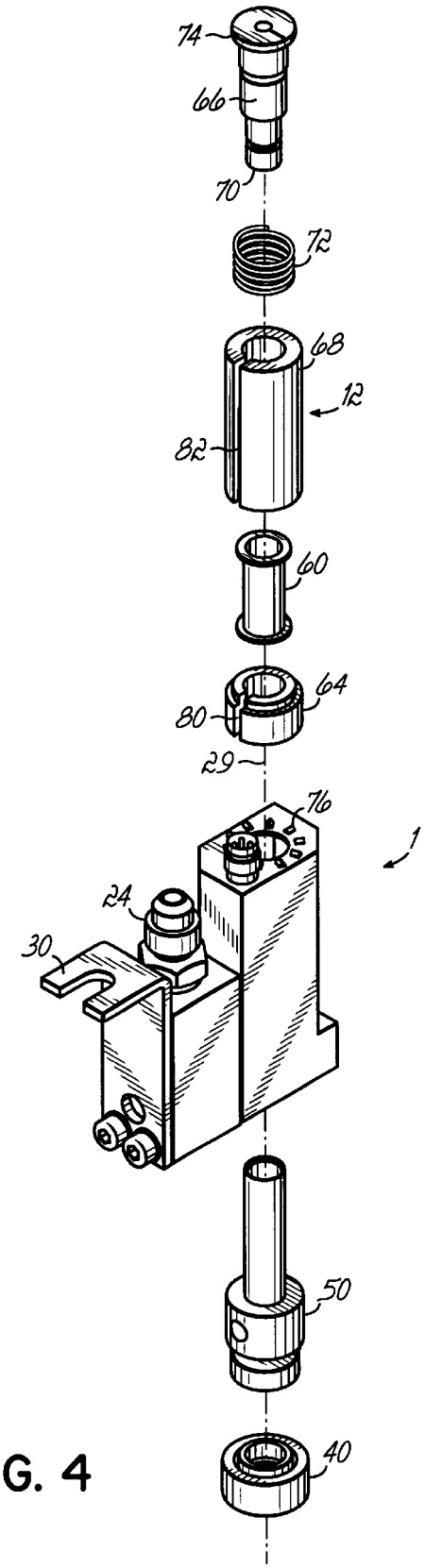
FIG. 4 shows a partially exploded view of the apparatus of FIG. 1.

As can be seen from FIGS. 1 and 2, the applicator head 1 has a main body 2 of cast synthetic material, which can be a hardened casting material such as polyurethane. The main body 2 is surrounded by a protective housing 4, which can be manufactured for example by injection molding and can consist of polyamide. Located in the main body 2 are a valve assembly 6, an outlet canal 8 which ends in an outlet opening 10, and a drive unit 12 for the valve assembly 6. A supply canal 14, which is connected to the source of material, communicates with the outlet canal 8.

A block-shaped connecting adapter 18 is screwed onto the side of the main body 2 by a spacer plate 16. The adapter 18 has a drilled hole or canal 20 and a second drilled hole or canal 22 at a right angle to canal 20. A hose connection adapter 24 is screwed into a threaded hole 26, which communicates with the canal 20, so that fluid material can flow through the hose, the connection adapter 24, the threaded hole 26, canals 20 and 22, and the supply canal 14, into the outlet canal 8, when the valve assembly 6 is in its open position.

The supply canal 14 is formed inside a sleeve 28 that is positioned radially relative to a longitudinal axis 29. The sleeve 28 is inserted through a hole drilled in the spacer plate 16 and the main body 2 and is screwed by its male threads into female threads in a sleeve 50. In the sleeve 28, a central flow canal forms the supply canal 14. The connection adapter 18 is attached to the main body 2 by means of threaded connections. An assembly clamp 30 is provided for attaching the applicator head 1 to a frame, robot arm or the like, and is screwed onto the connection adapter 18.

The valve assembly 6 comprises a valve seat 32 and a valve body 34 which can move relative to the valve seat 32, and a tensioning device in the form of a coil spring 36 for pre-tensioning the valve body 34 in the closed position (as shown) or in an open position (not shown). The valve seat 32 has a contact surface 38 and is part of a nozzle assembly 40. The nozzle assembly 40 also includes a nozzle 42 that has the outlet opening 10, a sleeve 44 that partially limits the outlet canal 8, and a nut 46. The sleeve 50 has a mounting adapter 48. The nut 46 has female threads and is screwed onto the mounting adapter 48 on the sleeve 50. Sleeve 50 is inserted into the main body 2 and protrudes from the main body 2. The outlet canal 8 is formed in part by the hole drilled in the sleeve 50.

The valve body 34 has the form of an elongated needle and is mounted on the main body 2, more precisely on an upper bearing section 52 of the sleeve 50, so that it can be moved axially back and forth translationally in the direction of the longitudinal axis 29. The valve body 34 can be moved from an open position, in which a ball-shaped lower part 54 of the valve body 34 is out of contact with the valve seat 32, so that a free flow section results, to a closed position in which the ball-shaped section 54 is in contact with the valve seat 32. The coil spring 36 is positioned inside the sleeve 50 and in the outlet canal 8. One end of the coil spring 36 is in contact with a projection formed on the sleeve 50. The other end of coil spring 36 contacts a ring-shaped projection 56 formed on the valve body 34 and pre-tensions the valve body 34 in the direction of the closed position. The projection 56 includes flow canals (not shown) so that material can flow through in the direction of the outlet opening 10 of the outlet canal 8.

The outlet canal 8 is formed in a lower area of the main body 2 and runs essentially in the axial direction with respect to the longitudinal axis 29. The supply canal 14 runs radially to the longitudinal axis 29.

In a lower section of the main body 2, that is, on the side of the outlet opening 10, the supply canal 14 is connected to the outlet canal 8. The flow path from where the supply canal 14 joins the outlet canal 8 (see reference symbol 58 in FIG. 1) to the outlet opening 10 is relatively short, so that only small losses of pressure occur. The tensioning device in the form of the coil spring 36 is also located in a lower section of the main body 2.

The drive unit 12 for moving the valve body 34 is an electromagnetic coil arrangement with a ring-shaped coil 60, which creates a magnetic field for exerting a force on the elongated, needle-like valve body 34 in the direction of the axis 29. Positioned concentric to the coil 60 is a sleeve-shaped magnetizable upper flux element or ring 68. Beneath the coil 60 is an additional adjoining magnetizable lower flux element or ring 64.

A pole piece 66 is positioned partially inside the ring-shaped coil 60 and is likewise magnetically operative. The arrangement of the pole piece 66, the flux ring 68 and the flux ring 64 causes a strong magnetic field to be formed, so that a strong axial force can be applied to the valve body 34 in order to move the closing body intermittently at high frequency from the open to the closed position and vice versa in conjunction with the coil spring 36.

Flux ring 64 includes a longitudinal slit 80 that extends along the entire axial dimension of flux ring 64 and extends radially relative to axis 29 through the thickness of flux ring 64. Similarly, extending along the entire axial dimension of flux ring 68 is a longitudinal slit 82, which also extends radially through the thickness of flux ring 68. The major dimension of each of the slits 80, 82 is aligned generally in the direction of the longitudinal axis 29, although the invention is not so limited. In particular, slits 80, 82 merely have to be aligned axially in a manner effective for disrupting circumferential current paths in flux rings 64, 68.

Slits 80, 82 are not occupied by the electrically-conductive material forming each of the corresponding flux rings 64, 68, which effectively interrupts potential closed-loop current paths in the flux rings 64, 68. As a result, electrical currents cannot circulate circumferentially about the flux rings 64, 68. Slits 80, 82 may be filled with the cast synthetic material of main body 2, which is an electrical insulator, or may constitute air-filled gaps encased within the cast synthetic material. The slits 80, 82 ensure that a magnetic field which has been generated by eddy currents in the flux rings 80, 82 decays rapidly, so that high switching frequencies of the drive unit 12 and, thus, rapid movements of the valve body 34 at high frequency are possible. Specifically, the magnetic field in flux rings 64, 68 dissipates more quickly, after the coil 60 is de-energized, due to the absence of circumferentially-extending electrical currents.

Inside an upper bearing section 63 of the valve body 34 is a central drilled hole 65 and a transverse hole 67 connecting to it. Fluid material can flow through at that point and possibly circulate when the valve body 34 is not in contact with the contact surface 70 of the pole piece 66.

The pole piece 66 is designed as an adjusting element which can be moved relative to the main body 2 and secured in various positions forming a stop for the movable valve body 34, so that the stroke of the movable valve body 34 is variable. To that end, the pole piece or adjusting element 66 has male threads which engage female threads in a sleeve 68, so that when the pole piece 66 is rotated around the longitudinal axis 28, the pole piece 66 moves axially. This changes the position of the lower contact surface 70 of the pole piece 66 relative to the main body 2, so that the position of the pole piece 66, which functions as a stop for the valve body 34, is varied.

A pre-tensioning force is exerted on the pole piece 66 by means of a coil spring 72. The coil spring 72 is in contact with an extended grip section 74 that is knurled on its circumferential surface. The pole piece 66 can easily be turned manually by the grip section 74 for adjusting the axial position of the pole piece 66. The invention contemplates that access to the grip section 74 of pole piece 66 may be restricted after the axial position of pole piece 66 is adjusted to provide a desired stroke. The limited accessibility reduces the occurrence of inadvertent or unintentional axial movement of pole piece 66.

Figure 3:
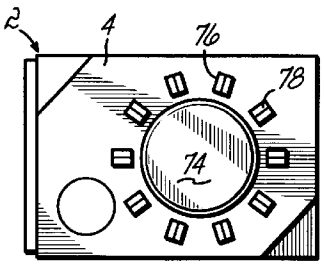
FIG. 3 shows a top view of the apparatus of FIG. 2.

As can be seen from FIG. 3, markings 78 are provided on the surface of the housing 4 in the area of a projection 76. Markings 78, together with a marking (not shown) on the grip section 74 of the pole piece 66, indicate the axial position of the pole piece 66 and, thus, of the contact surface 70.

While the present invention has been illustrated by a description of a preferred embodiment and while this embodiment has been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims, wherein we claim:

What is claimed is:

1. An electrically-operated dispensing module for dispensing adhesive onto a substrate, comprising:

a main body having an outlet canal capable of receiving adhesive and an outlet opening for discharging adhesive flowing through said outlet canal onto the substrate;

a pole piece positioned within said main body;

a valve assembly positioned within said outlet canal, said valve assembly having a valve seat and a valve body movable relative to said valve seat between a closed position interrupting a flow of adhesive in said outlet canal by engaging said valve body with said valve seat and an open position releasing the flow of adhesive in said outlet canal to said outlet opening by disengaging said valve body from said valve seat;

an electromagnetic drive unit capable of generating a magnetic field for moving said valve body relative to said pole piece between said closed and open positions; and a flux element positioned proximate to said electromagnetic drive unit, said flux element including a slit capable of interrupting circumferential electrical current paths therein, said slit being filled with an electrically-insulating synthetic material.

2. The electrically-operated dispensing module of claim 1 wherein said flux element and said electromagnetic drive unit are aligned along a longitudinal axis, said flux element has an axial dimension, and said slit extends fully along said axial dimension of said flux element.

3. The electrically-operated dispensing module of claim 2, wherein said slit is parallel to said longitudinal axis.

4. The electrically-operated dispensing module of claim 1 wherein said valve body includes a central flow passageway and a transverse flow passageway coupling said central flow passageway in fluid communication with said outlet canal.

5. The electrically-operated dispensing module of claim 1 further comprising an outer protective housing surrounding said flux element, said pole piece, said valve body and said electromagnetic drive unit.

6. An electrically-operated dispensing module for dispensing adhesive onto a substrate, comprising:

a main body having an outlet canal capable of receiving adhesive and an outlet opening for discharging adhesive flowing through said outlet canal onto the substrate;

a pole piece positioned within said main body;

a valve assembly positioned within said outlet canal, said valve assembly having a valve seat and a valve body movable relative to said valve seat between a closed position interrupting a flow of adhesive in said outlet canal by engaging said valve body with said valve seat and an open position releasing the flow of adhesive in said outlet canal to said outlet opening by disengaging said valve body from said valve seat;

an electromagnetic drive unit capable of generating a magnetic field for moving said valve body relative to said pole piece between said closed and open positions; and first and second flux elements positioned proximate to said electromagnetic drive unit, said first and second flux elements each including a portion capable of interrupting circumferential electrical current paths therein.

7. The electrically-operated dispensing module of claim 6 wherein said portion is a slit effective to prevent circumferential electrical currents in each of said first and second flux elements.

8. The electrically-operated dispensing module of claim 7, wherein said first and second flux elements and said drive unit are aligned along a longitudinal axis, said first and second flux elements each have an axial dimension, and said slit extends fully along said axial dimension of a corresponding one of said first and second flux elements.

9. The electrically-operated dispensing module of claim 8 wherein said slit is parallel to said longitudinal axis.

10. The electrically-operated dispensing module of claim 6 wherein said portion is formed from an electrically insulating material, said first and second flux elements and said drive unit are aligned along a longitudinal axis, said first and second flux elements each have an axial dimension, and said slit extends fully along said axial dimension of a corresponding one of said first and second flux elements for defining respective gaps.

11. The electrically-operated dispensing module of claim 6 wherein said valve body includes a central flow passageway and a transverse flow passageway coupling said central flow passageway in fluid communication with said outlet canal.

12. The electrically-operated dispensing module of claim 6 further comprising an outer protective housing surrounding said flux element, said pole piece, said valve body and said drive unit.

13. An electrically-operated dispensing module for dispensing adhesive from a source of adhesive onto a substrate, comprising:

a main body having a supply canal configured to receive adhesive from the source of adhesive, an outlet canal coupled in fluid communication with said supply canal, and an outlet opening for discharging the adhesive flowing through said outlet canal onto the substrate, said supply canal extending through said main body transverse to said outlet canal;

a pole piece positioned within said main body;

a valve assembly including a valve seat and a valve body movable relative to said pole piece between a closed position interrupting a flow of adhesive in said outlet canal by engaging said valve body with said valve seat and an open position releasing the flow of adhesive in said outlet canal to said outlet opening by disengaging said valve body from said valve seat;

an electromagnetic coil capable of generating a magnetic field to move said valve body relative to said pole piece to provide said closed and open positions;

a flux element at least partially surrounding said valve body, said flux element operative for amplifying the magnetic field generated by said electromagnetic coil, said flux element including a slit capable of interrupting circumferential electrical current paths therein, said slit being filled with an electrically-insulating synthetic material; and a coil spring positioned within said outlet canal and configurable for biasing said valve body relative to said pole piece, said coil spring including opposed first and second ends located between said flux element and said outlet opening, and said supply canal intersecting said outlet canal between said first and second ends of said coil spring.

14. The device of claim 13 wherein said valve body is elongated and includes a substantially ring-shaped projection against which said coil spring is compressed.

15. The device of claim 14 wherein said ring-shaped projection has flow canals through which the adhesive can flow.

16. The device of claim 13 wherein said main body includes a sleeve inserted into said main body and said outlet canal is positioned at least partially inside of said sleeve.

17. The device of claim 16 wherein said sleeve has a lower attaching projection spaced away from said lower section of said main body and said main body includes a nozzle assembly containing said outlet opening, said nozzle assembly attached to said lower attaching projection.

18. The device of claim 13 wherein said main body is formed of a synthetic material.

19. The device of claim 13 further comprising a housing formed as an injection molded part, said housing enclosing said main body.

* * * * *

UNITED STATES PATENT AND TRADEMARK OFFICE

CERTIFICATE OF CORRECTION

PATENT NO. : 6,761,290 B2
DATED : July 13, 2004
INVENTOR(S) : Hendrik-Jan Righolt et al.

It is certified that error appears in the above-identified patent and that said Letters Patent is hereby corrected as shown below:

Column 10,
Line 3, change "13" to -- 18 --

Signed and Sealed this

Fifth Day of April, 2005

JON W. DUDAS
*Director of the United States Patent and Trademark Office*